United States Patent [19]

Sagaser

[11] Patent Number: 4,844,685

[45] Date of Patent: Jul. 4, 1989

[54] ELECTRONIC BUCKET POSITIONING AND CONTROL SYSTEM

[75] Inventor: Thomas M. Sagaser, Bismark, N. Dak.

[73] Assignee: Clark Equipment Company, South Bend, Ind.

[21] Appl. No.: 903,160

[22] Filed: Sep. 3, 1986

[51] Int. Cl.[4] ..... E02F 3/34

[52] U.S. Cl. ..... 414/700; 414/699; 414/701; 414/708; 91/363 R; 91/512; 91/513

[58] Field of Search ..... 414/699, 700, 701, 706, 414/708, 697, 698; 318/568; 364/513; 91/361, 363 R, 512, 513, 527, 530, 531; 901/5

[56] References Cited

U.S. PATENT DOCUMENTS

| | | | |
|---|---|---|---|
| 3,643,828 | 2/1972 | Elliott | 414/699 |
| 3,726,191 | 4/1973 | Johnston et al. | 91/363 R X |
| 3,726,428 | 4/1973 | Lark et al. | 414/700 |
| 3,794,199 | 2/1974 | Bromberek et al. | 414/701 X |
| 3,843,004 | 10/1974 | Kambe | 414/700 |
| 3,915,325 | 10/1975 | Lark et al. | 414/701 |
| 3,924,766 | 12/1975 | Canning | 414/701 |
| 4,015,729 | 4/1977 | Parquet et al. | 91/361 X |
| 4,037,742 | 7/1977 | Gustafsson | 414/694 |
| 4,059,196 | 11/1977 | Uchino et al. | 414/699 |
| 4,109,812 | 8/1978 | Adams et al. | 414/699 |
| 4,288,196 | 9/1981 | Sutton, II | 414/699 |
| 4,332,517 | 6/1982 | Igarashi et al. | 414/699 |
| 4,358,989 | 11/1982 | Tordenmalm | 91/361 |
| 4,377,043 | 3/1983 | Innui et al. | 37/18 R |
| 4,386,552 | 6/1983 | Foxwell | 91/363 R X |
| 4,408,518 | 10/1983 | Diel et al. | 91/31 |
| 4,420,812 | 12/1983 | Ito et al. | 901/5 X |
| 4,516,117 | 5/1985 | Couture et al. | 340/685 |
| 4,552,503 | 11/1985 | Mouri et al. | 414/687 |

*Primary Examiner*—Frank E. Werner
*Assistant Examiner*—Donald W. Underwood
*Attorney, Agent, or Firm*—Kinney & Lange

[57] ABSTRACT

An electronic bucket positioning and control system for a vehicle of the type including a hydraulically controlled boom assembly and bucket. The bucket positioning and control system can operate in a bucket positioning mode, bucket return to position mode, bucket anti-rollback mode, and tilt cushion mode.

27 Claims, 8 Drawing Sheets

3
80
90
72
64
74
92
102
82
85
109
108
93
106
89
95
94
88
86
101
107

ELECTRONIC BUCKET POSITIONING AND CONTROL SYSTEM

BACKGROUND OF THE INVENTION

1. Field of the Invention

The present invention relates generally to boom and attachment control systems for vehicles. In particular, the present invention is an electronic bucket positioning and control system.

2. Description of the Prior Art

Vehicles such as articulated loaders, skid steer loaders and back hoes are well known. Vehicles of these types typically include a body, a frame or other support structure to which a boom assembly is pivotally mounted. An attachment such as a bucket is pivotally mounted to the boom assembly. A hydraulic system is also typically included for driving the boom assembly and bucket. The hydraulic system can include one or more hydraulic lift cylinders for driving the boom assembly with respect to the support structure, and one or more hydraulic tilt cylinders for driving the bucket with respect to the boom assembly. Through the use of a control handle, an operator will actuate a tilt valve to control the tilt cylinders, and a lift valve to control the lift cylinders. In one conventional system, the operator will push the control handle forward to lower the boom assembly, pull the control handle backward to lift the boom assembly, move the control handle to the left to roll the bucket back, and move the handle to the right to dump or roll the bucket out.

When using hydraulic control systems of the type described above, the operator often repetitively performs many operations. When raising or lowering the boom assembly with a loaded bucket, for example, the operator must constantly make sure that the bucket is kept in a predetermined angular relationship with respect to the vehicle body or support structure to prevent the load from being accidentally spilled. The operator is therefore required to visually monitor the angular position of the bucket, and to adjust the bucket's position relative to the boom assembly while simultaneously raising or lowering the boom assembly. Although hydraulic self-leveling systems are known and disclosed, for example, in the Diel et al U.S. Pat. No. 4,408,518, systems of this type are relatively complicated, and typically work only when the boom assembly is being raised.

Another repetitively performed operation is that of returning the bucket to a predetermined position after it has been rolled out or rolled back. For example, after dumping a load it is typically required to return the bucket to a digging position before another load can be scooped. Known return to position systems include an operator actuated switch which will activate a magnet or other mechanism to hold the tilt valve in a position which will cause the bucket to be rolled back to a position determined by a limit switch mounted on the boom assembly. When the bucket has rolled back and actuates the limit switch, the mechanism holding the tilt valve is released.

The precise rollback position is set by physically adjusting the position of the limit switch. This prior art system, however, only permits the bucket to be returned to one position which is set by the limit switch. In addition, it only permits the bucket to be returned to a predetermined rollback position after being dumped. It is often desirable, however, to vary the position to which the bucket should be returned. It is also often necessary to return the bucket to a predetermined position from a completely rolled back position as well as from a rolled out or dumped position.

Another commonly performed operation is that of actuating the tilt valve to bang the hydraulic tilt cylinder at its end of travel so as to jar debris free from the bucket. This banging results in the pistons of the hydraulic tilt cylinders being forced against stops at the end of the cylinder, and results in unnecessary wear. Although the hydraulic tilt cylinders typically have a hydraulic fluid port spaced from the end of the cylinder thereby preventing hydraulic fluid from rapidly exiting the cylinder when the piston is near the end of its travel limit, and somewhat dampening the forces applied to the cylinder, this mechanism still permits large forces to be applied to the cylinder. This hydraulic cushion system prevents banging which is sometimes needed to jar debris free.

It is evident that there is a continuing need for improved boom and bucket control systems for vehicles of this type described above. A system capable of maintaining the bucket at any desired angular relationship with respect to the vehicle as the boom assembly is being raised or lowered would be desirable. The system should also be capable of automatically prohibiting the bucket from being rolled back to positions at which the load may spill over the back of the bucket.

A control system which permits the operator to select any desired position to which the bucket can be returned would also be desirable. In addition, the system should be capable of returning the bucket to the desired position from either direction of travel. A control system which also prohibits unnecessary wear on the tilt cylinders when the bucket is banged at the end of its cylinder stroke, yet still permits banging, would help extend the life of the cylinders. The control system must, of course, be relatively inexpensive and reliable to be commercially feasible. It would also be useful if the control system could be implemented along with existing hydraulic control systems. The hydraulic system should also be capable of manual actuation should any elements of the control system fail for any of a variety of reasons.

SUMMARY OF THE INVENTION

The present invention is an electronic bucket positioning and control system. The system can be implemented along with existing hydraulic control systems on vehicles. It is also relatively inexpensive and reliable since it is microprocessor based. In addition, the system can be operated in a variety of different modes. Should any electrical elements of the control system fail, an operator can still manually actuate the hydraulic system. Excessive down time can thereby be prevented.

One embodiment of the positioning and control system includes a boom assembly having a first end which is pivotally mounted to a support structure. An attachment, such as a bucket, is pivotally mounted to the second end of the support structure. The boom assembly is driven with respect to the support structure by at least one hydraulic lift cylinder. The attachment is driven with respect to the boom assembly by at least one hydraulic tilt cylinder. Lift sensor means provide lift position signals representative of the position of the boom assembly with respect to the support structure. Tilt sensor means provide tilt position signals representative of the position of the attachment with respect to the boom assembly. Also included is a multiple spool series valve which has an operator actuated hydraulic tilt valve for controlling the tilt cylinder, an operator actuated hydraulic lift valve for controlling the lift cylinder, and an electrically actuated hydraulic tilt valve which is responsive to tilt control signals for controlling the tilt cylinder. Memory means is used to store data. Control means coupled to the lift sensor means, tilt sensor means, memory means and electrically actuated tilt valve means provide tilt control signals as a function of the stored data, lift position signals and tilt position signals.

In a preferred embodiment, the system includes positioning mode switch means coupled to the control means for causing the system to operate in a bucket positioning mode when actuated. Data representative of a predetermined angular position between the bucket and support structure is stored in the memory means. The control means provides positioning tilt control signals causing the bucket to maintain the predetermined angular position as the boom assembly is driven with respect to the support structure. Select means for selecting the predetermined angular position can also be included.

In another preferred embodiment, the positioning and control system includes return to position mode switch means coupled to the control means for causing the system to operate in a bucket return to position mode, when actuated. Data representative of a predetermined angular set position between the bucket and the boom assembly is stored in the memory means. The control means provides return to position tilt control signals causing the bucket to be driven to the predetermined angular set position. Return to position set switch means for causing the memory means to store data representative of the predetermined set position, and enable switch means for enabling the control means to provide the return to position tilt control signals can also be included.

In another preferred embodiment, the positioning and control system operates in an anti-rollback mode. Data representative of a minimum rollout angle of the bucket attachment with respect to the support structure is stored in the memory means. The control means provides anti-rollback tilt control signals preventing the bucket from being driven to a position having a rollout angle with respect to the support structure which is less than the minimum rollout angle.

In still another embodiment, the positioning and control system operates in a tilt cushion mode. Data representative of a first cushion distance is stored in the memory means. The control means provides cushioning tilt control signals causing speed of a piston to slow when the piston is being extended within the tilt cylinder, and is within the first cushion distance of an extension end position. Data representative of a second cushion distance can also be stored in the memory. The control means disables production of the cushioning tilt control signals when the piston is retracted from the extension end position by less than the second cushion distance before again being extended.

DETAILED DESCRIPTION OF THE PREFERRED EMBODIMENTS SYSTEM OVERVIEW

Figure 1:
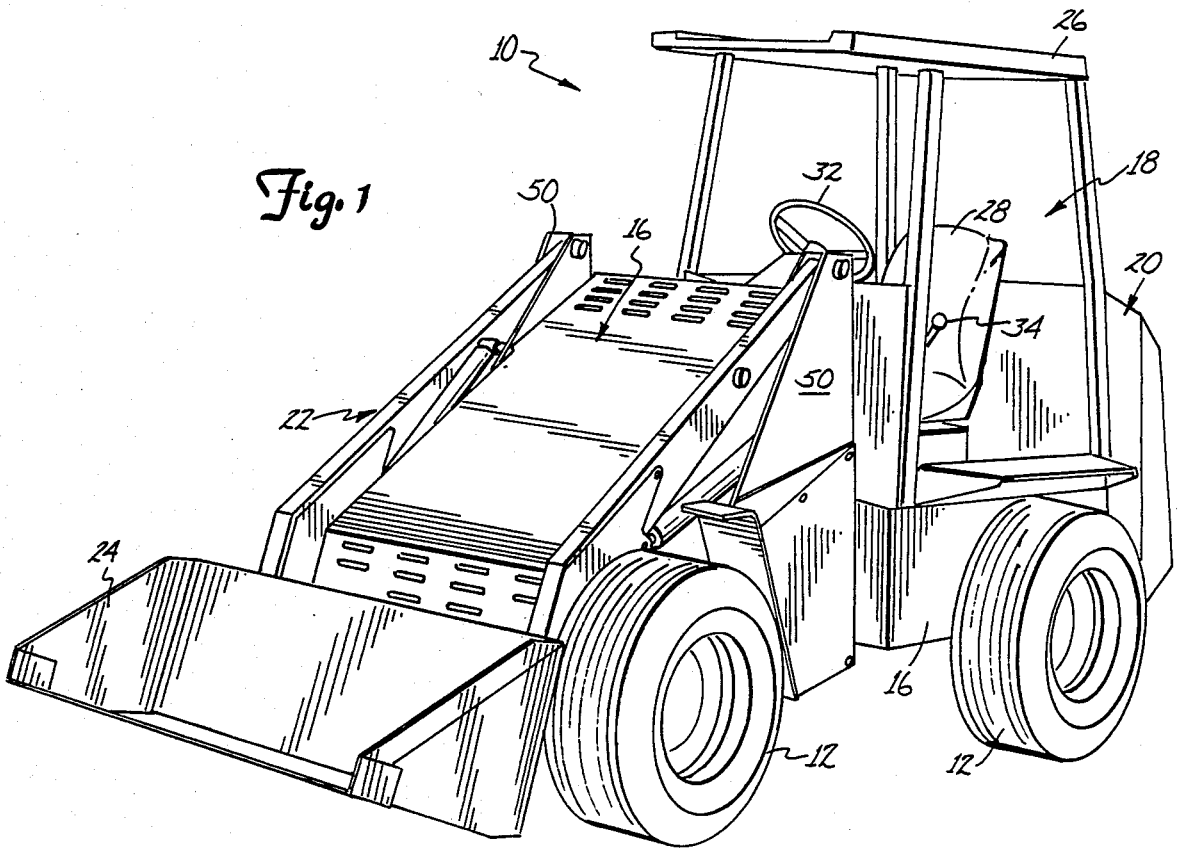
FIG. 1 is a perspective view of an articulated loader which can utilize the bucket positioning and control system of the present invention.

The present invention is an electronic attachment positioning and control system which will typically be included on various types of vehicles. The embodiment described herein is an electronic bucket positioning and control system which is included on an articulated loader 10 such as that shown generally in FIG. 1. Articulated loader 10 includes an articulated frame or other support structure (not visible) which is supported for over-the-ground travel by wheels 12. A chassis or body 16 is mounted to the frame and includes an operator's compartment 18 and an engine compartment 20. Also mounted to the frame or other support structure in front of operator's compartment 18 is boom assembly 22, to which an attachment such as bucket 24 is mounted.

An engine, cooling system, and hydraulic system (not separately shown) are typically mounted within engine compartment 20. A hydrostatic or other drive mechanism (also not shown) for rotating wheels 12 is interfaced to the motor and can be located on a front part of the frame. Operator's compartment 18 is enclosed by an overhead framework or guard 26. An operator will sit on a seat 28 and control the speed and steering of articulated loader 10 by means of a throttle or foot pedal (not shown) and steering wheel 32, respectively. A joystick-type control handle 34 is also positioned within operator's compartment 18 and is utilized by the operator to control boom assembly 22 and bucket 24. Other control switches to be described in subsequent portions of this specification which are actuated by the operator to control the bucket positioning and control system of the present invention can also be mounted within reach of the operator in operator's compartment 18.

Figure 2:
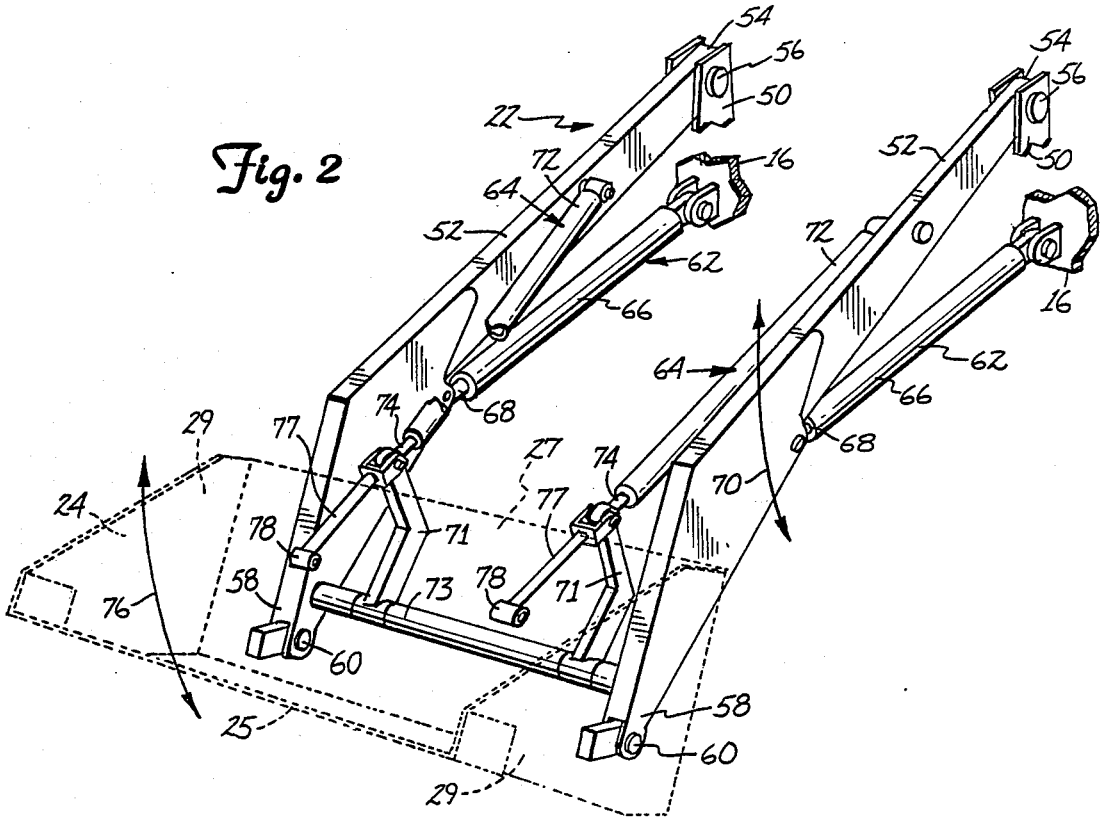
FIG. 2 is a detailed view of the boom assembly and bucket shown in FIG. 1, with parts thereof shown in phantom.
Figure 3:
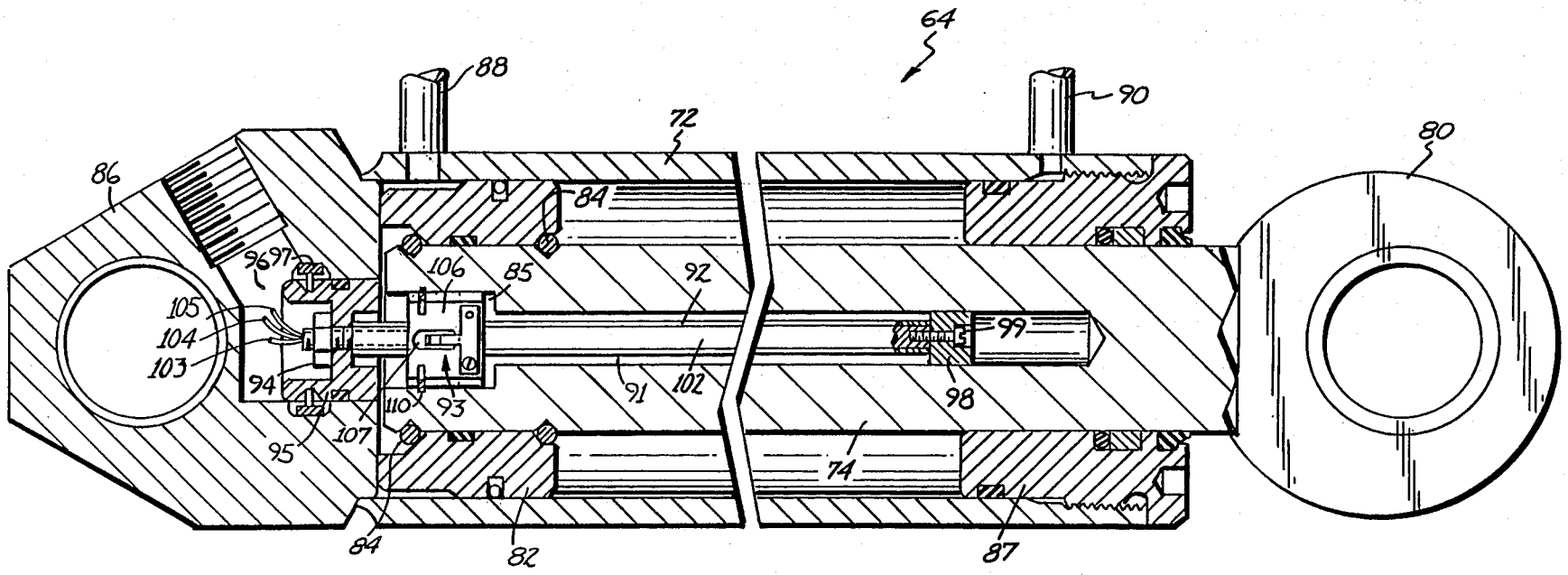
FIG. 3 is a sectional view of a hydraulic cylinder such as that shown in FIGS. 1 and 2, illustrating one embodiment of an encoding mechanism included therein.
Figures 4, 5, 6:
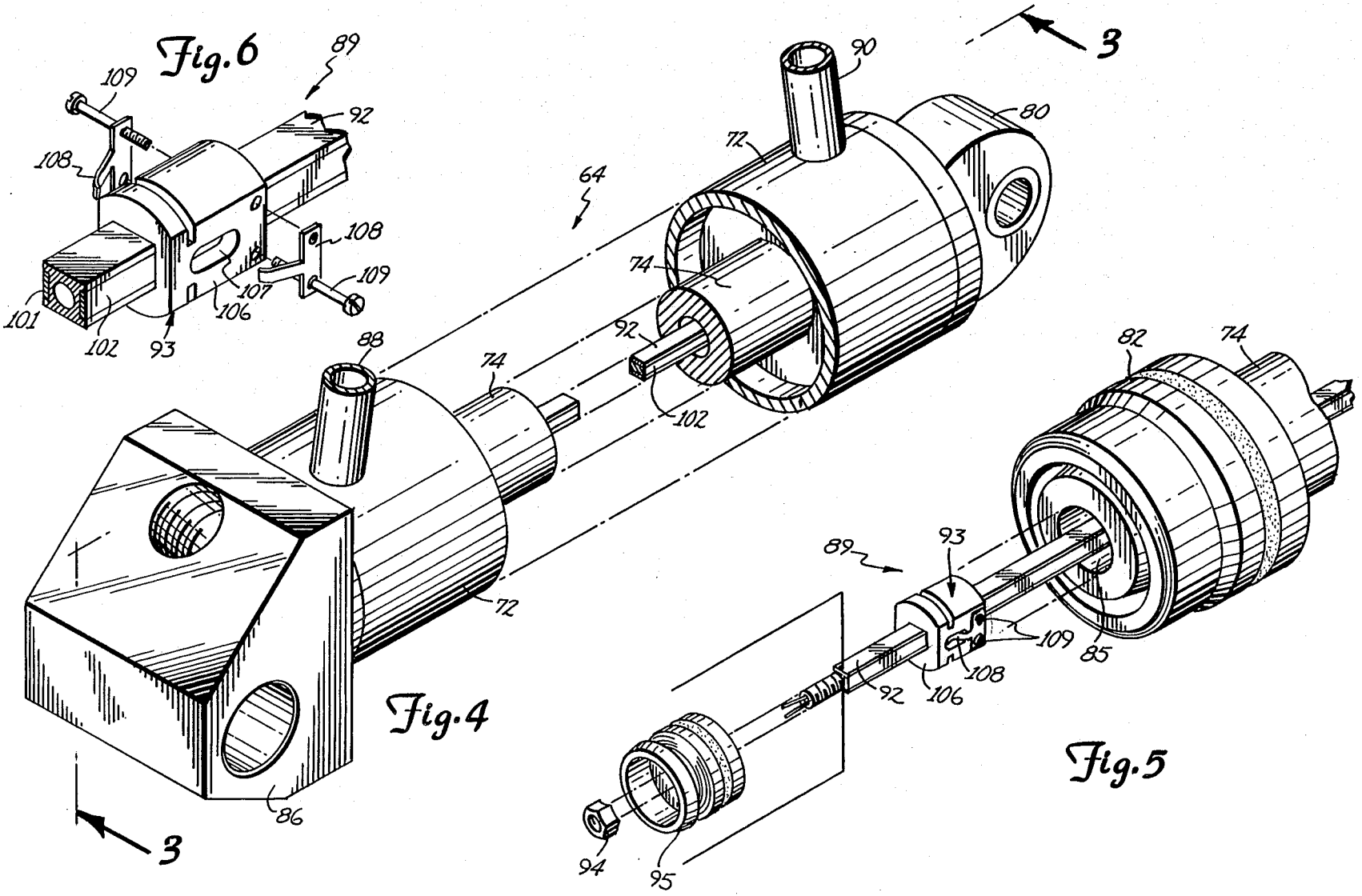
FIG. 4 is an exploded view of the cylinder shown in FIG. 3.
FIG. 5 is a detailed view of the piston shown in FIG. 3, with the encoding mechanism shown in exploded form.
FIG. 6 is a detailed view of the encoding mechanism shown in FIG. 5.

Boom assembly 22 and bucket 24 are shown in greater detail in FIG. 2. Uprights 50 extend in a generally vertical direction on both sides of loader 10. Boom assembly 22 includes a pair of lift arms 52, each of which has a first end 54 which is pivotably mounted to one of uprights 50 by means of pivot pins 56. Bucket 24 is pivotably mounted to a second end 58 of lift arms 52 by means of pivot pins 60, and includes a bottom panel 25, back panel 27, and side panels 29.

Boom assembly 22 also includes a pair of boom lift cylinders 62 and a pair of bucket tilt cylinders 64, all of which are interfaced to the hydraulic system. Lift cylinders 62 each include a cylinder housing 66 which has an end pivotably mounted to body 16, and a piston rod 68 which has an end pivotably mounted to one of lift arms 52. When actuated by the hydraulic system, piston rods 68 will extend and retract within cylinder housings 66 thereby causing boom assembly 22 (i.e., lift arms 52) to be raised and lowered about boom travel path 70.

Tilt cylinders 64 each include a cylinder housing 72 which has an end pivotally mounted to one of lift arms 52, and a piston rod 74 which has an end pivotably mounted to upright members 71 of a tilt linkage. The tilt linkage also includes a cross member 73 which extends between lift arms 52. Tilt links 77 have a first end 78 pivotally mounted to back panel 27 of bucket 24, and couple tilt cylinders 64 to the bucket. When actuated by the hydraulic system, piston rods 74 will extend and retract within cylinder housings 72, thereby causing bucket 24 to rotate about bucket travel path 76. The motion of bucket 24 when piston rods 74 are retracted and back panel 27 moves toward body 16 is characterized as rollback, while the motion of the bucket when the piston rods are extended causing the back panel to rotate away from the body is called rollout.

The bucket control system of the present invention utilizes encoders or sensors to provide signals representative of the position of boom assembly 22 and bucket 24 about their respective travel paths 70 and 76. Although other types of sensors for providing these signals are within the scope of the claimed invention, the embodiment described herein includes a sensor mechanism within lift cylinders 62 and tilt cylinders 64. A preferred embodiment of a tilt cylinder 64, which is also representative of lift cylinders 62, is shown in greater detail in FIGS. 3–7.

Piston rod 74 includes a mounting clevis 80 on a first end thereof, and has its second or opposite end affixed to piston 82 by means of fastening rings 84. Cylinder housing 72 includes a mounting clevis 86 at a first end opposite cylinder 64 from mounting clevis 80 of piston rod 74. The second or opposite end of cylinder housing 72 is sealed by cylinder stop 87. In response to the flow of hydraulic fluid through base port 88 and rod port 90, piston 82 will be driven within cylinder housing 72 between mounting clevis 86 and cylinder stop 87 in a well known manner.

Tilt cylinder 64 also includes a sensor mechanism 89 for providing an electric signal representative of the extent or length that piston rod 74 is extended or retracted within cylinder housing 72. To receive sensor mechanism 89, piston rod 74 includes a cavity 91 which extends axially most of the way through the center of the rod from the end adjacent piston 82. Cavity 91 includes an enlarged portion 85 at the end adjacent piston 82. Sensor mechanism 89 includes a rigid rod 92 and a slide assembly 93. A first end of rod 92 is threaded and attached by nut 94 to mounting assembly 95. Mounting assembly 95, in turn, is fixed within cavity 96 of clevis 86 by means of fastening ring 97. A second end of rod 92 is fastened to slide bushing 98 by screw 99.

Figure 7:
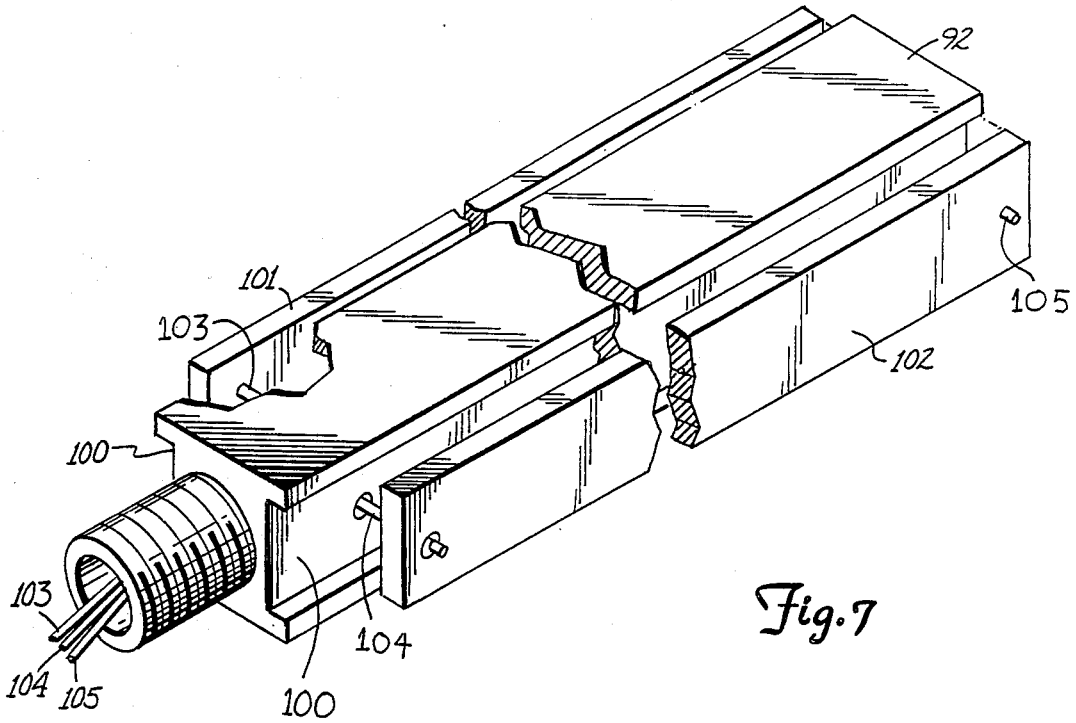
FIG. 7 is a detailed exploded view of the rod shown in FIG. 6, illustrating the conductor and resistance strip.

As perhaps best shown in FIG. 7, rod 92 includes two grooves 100 on opposite sides thereof, and a clear hole running lengthwise through the rod. Mounted within one groove 100 is a conductive strip 101 which can be fabricated of various materials such as laminated conductive plastic. A linear resistance strip 102 is fastened within opposite groove 100. Conductor 101 and linear resistance strip 102 are electrically insulated from rod 92. Wire leads 103 and 104 are connected to conductors 101 and 102, respectively, at the end adjacent mounting assembly 95, and extend into cavity 96. A wire lead 105 extends from cavity 96 through the clear hole of rod 92 to the end of resistance strip 102 opposite that of wire lead 104.

Slide assembly 93 includes a slide member 106 which circumferentially surrounds rod 92 and is slidable along the rod. Slide member 106 includes holes 107 through opposite sides thereof (only one is visible) which are positioned in such a manner as to permit access to conductor 101 and resistance strip 102. Wiper contacts 108 are mounted to slide member 106, and are electrically coupled to one another, by screws 109. Wiper contacts 108 are adapted to fit within holes 107 and slidably contact one of conductor 101 and resistance strip 102. As perhaps best shown in FIG. 3, slide assembly 93 is fastened to piston rod 74 within enlarged portion 85 of cavity 91 by fastening ring 110.

In operation, sensor mechanism 89 provides an electric signal having a magnitude representative of the degree to which piston rod 74 is extended or retracted within cylinder housing 72. To this end, an electric signal having predetermined voltage is applied across resistance strip 102 through wire leads 104 and 105. As piston rod 74 is extended and retracted within cylinder housing 72, slide assembly 93 slides along rod 92 with wiper contacts 108 electrically coupling resistance strip 102 to conductor 101. Sensor mechanism 89 thereby functions in a manner similar to a potentiometer, with the voltage received through lead 103 from contact strip 101 being representative of the position of slide assembly 93 along rod 92, and therefore representative of the degree to which piston rod 74 has been extended or retracted.

Figure 8:
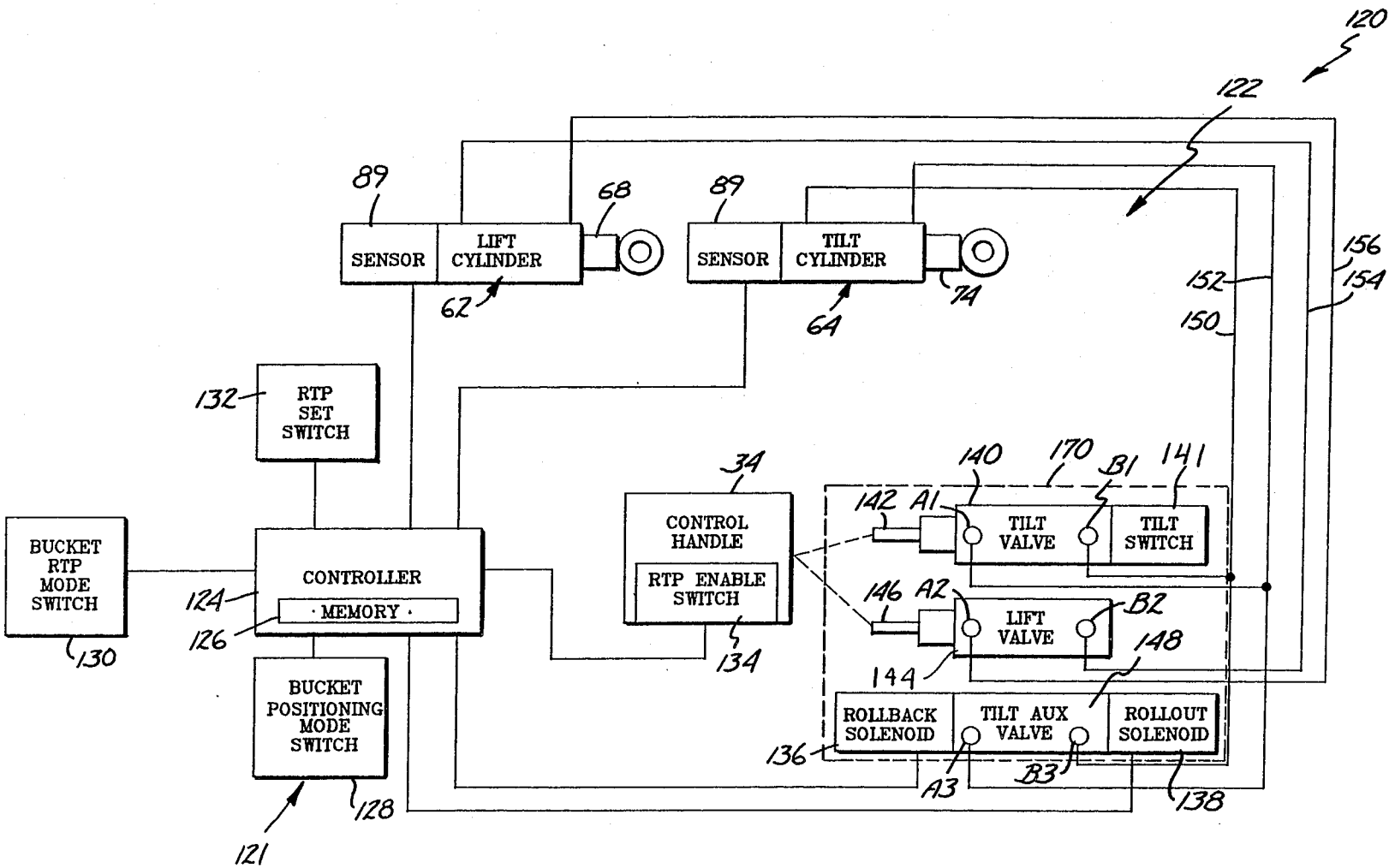
FIG. 8 is a block diagram representation of one embodiment of the bucket positioning and control system of the present invention.

One embodiment of bucket positioning and control system 120 of the present invention is illustrated schematically in FIG. 8. Electronic control subsystem 121 thereof includes a microprocessor based controller 124 and associated memory 126, a bucket positioning mode switch 128, a bucket return to position (RTP) mode switch 130, RTP set switch 132, RTP enable switch 134, rollback solenoid 136, rollout solenoid 138, tilt switch 141 and sensors 89 of lift cylinders 62 and tilt cylinders 64 (only one lift and tilt cylinder are shown). A hydraulic control subsystem 122 includes control handle 34, tilt actuator or valve 140 and its associated spool 142, lift actuator or valve 144 and its associated spool 146, tilt auxiliary (tilt aux) actuator or valve 148, lift cylinders 62 and tilt cylinders 64.

An operator can manually control boom assembly 22 and bucket 24 (FIG. 1) through the use of control handle 34. When spool 142 is actuated in a first direction from its center or neutral position by control handle 34, tilt valve 140 will cause hydraulic fluid to flow in a first direction through hydraulic lines 150 and 152, thereby actuating tilt cylinder 64 and causing piston rod 74 to extend therefrom. Motion of piston rod 74 stops when spool 142 is returned to its neutral position. When control handle 34 is moved in the opposite direction, spool 142 is actuated in a second direction from its neutral position causing hydraulic fluid to flow in the opposite direction and retracting piston rod 74. Bucket 24 is thereby driven along its travel path 76 (FIG. 2), with tilt position signals representative of the position of piston rod 74 provided to controller 124 by sensor 89.

Tilt switch 141 is responsive to spool 142, and provides manual tilt signals to controller 124 whenever the spool is moved from its normal position by control handle 34.

Lift cylinder 62 is hydraulically controlled by lift valve 144 through hydraulic lines 154 and 156 when spool 146 is actuated by control handle 34 in a manner similar to that of tilt cylinder 64 and described above. Boom assembly 22 is thereby driven along its travel path 70, with lift position signals representative of the position of piston rod 68 provided to controller 124 by its sensor 89.

Tilt cylinder 64 can also be electrically actuated by controller 124. Controller 124 provides tilt control signals to rollback solenoid 136 and rollout solenoid 138 in a manner causing tilt auxiliary valve 148 to hydraulically actuate tilt cylinder 64. As shown, tilt auxiliary valve 148 is connected externally in a parallel hydraulic circuit with tilt valve 140 to tilt cylinder 64 through hydraulic lines 150 and 152 (i.e., work ports B1 and B3 of tilt valve 140 and tilt auxiliary valve 148, respectively, are both connected to the base port of tilt cylinder 64 through hydraulic line 150, while work ports A1 and A3 are both connected to the rod port of the cylinder through line 152). When tilt control signals are provided to rollout solenoid 138, the spool (shown in FIG. 12) of tilt auxiliary valve 148 is moved in a first direction from its neutral position causing piston rod 74 to extend from tilt cylinder 64. When tilt control signals are provided to rollback solenoid 136, the spool of tilt auxiliary valve 148 is moved in a second direction from its neutral position causing piston rod 74 to retract within tilt cylinder 64. When no tilt signals are applied to either solenoid 136 or 138, the spool will be biased to its neutral position with piston rod 74 remaining at its previously set position.

Tilt valve 140, lift valve 144 and tilt auxiliary valve 148 are preferably elements of a multiple spool series valve block such as three spool series valve block 170. Series valve block 170 is illustrated in greater detail in FIG. 12. Valve block 170 includes a monoblock casting 172 in which spool 142 of tilt valve 140, spool 146 of lift valve 144, and spool 174 of tilt auxiliary valve 148 are positioned. Series valve blocks such as 170 are well known and include an open flow channel 176 by which valves 140, 144 and 148 are coupled in a series hydraulic circuit through their respective spools 142, 146 and 174, and a drain passageway 178. Hydraulic fluid from fluid reservoir 180 is pumped by pump 182 to open flow channel 176 at a point upstream from tilt valve 140 through inlet port 184. From drain port 186, which is within drain passageway 178 downstream from tilt auxiliary valve 148, hydraulic fluid is returned to reservoir 180. In the embodiment shown, tilt auxiliary valve 148 is located immediately upstream from downstream from inlet port 140 is located immediately downstream from inlet port 184, and lift valve 144 is located between the tilt and tilt auxiliary valves. Flow channel 176 and drain passageway 178 are coupled by relief valve 188.

Figure 9:
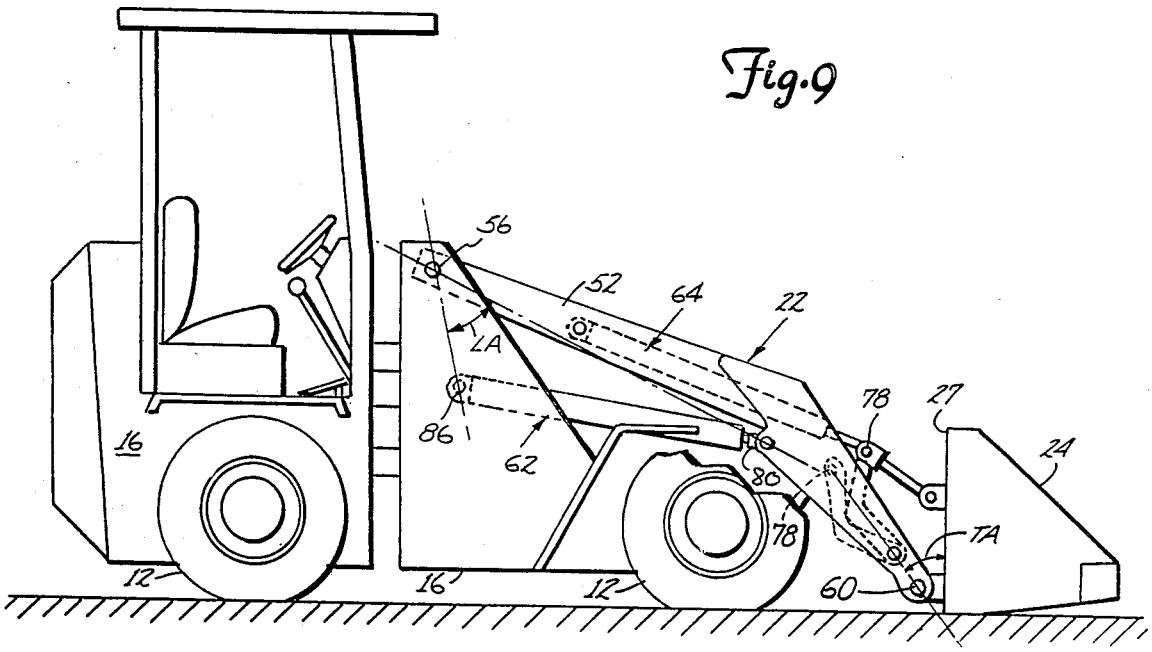
FIG. 9 is a side view of the boom assembly and bucket shown in FIG. 2, with parts thereof shown in phantom to illustrate their geometrical relationship.

Positions of boom assembly 22 and bucket 24 can be represented for purposes of calculation and control by controller 124 as a lift angle (LA) and tilt angle (TA), respectively, as shown in FIG. 9. In one embodiment, controller 124 relates the position of boom assembly 22 to the lift angle LA between a first axis extending between pivot pins 56 of lift arms 52 and mounting brackets 86 of lift cylinders 62, and a second axis extending between pivot pins 56 and mounting brackets 80 of the lift cylinders. Since signals representative of the length (i.e., the amount of extension or retraction) of lift cylinder 62 are provided by sensors 89 to controller 124, lift angle LA can be determined as a function of the length of lift cylinder 62 and the known lengths of the first and second axes. Lift angle LA has a minimum value when piston rods 68 are fully retracted within lift cylinder 62, and a maximum value when piston rods 68 are completely extended from cylinder 62.

In a similar manner, controller 124 relates the position of bucket 24 about bucket travel path 76 to the tilt angle TA between a first axis defined by the plane of back plate 27 of bucket 24, and a second axis extending between pivot pins 60 and the position of ends 78 of tilt links 77 when piston rods 74 of tilt cylinders 64 are fully retracted. Tilt angle TA can be determined from the tilt position signals provided by sensors 89 of tilt cylinders 64 as a geometric function of the magnitude of the position signals and the known geometry of the tilt linkage. When piston rods 75 of tilt cylinders 64 are fully retracted, for example, the tilt angle will be a minimum value. When piston rods 74 are completely extended, the tilt angle will be at a maximum value.

In one embodiment, memory 126 is programmed with data and equations characterizing the functional relationship between the magnitude of the lift position signals received from sensor 89 of lift cylinders 62, and lift angle LA, and characterizing the functional relationship between the tilt position signals provided by sensors 89 of tilt cylinders 64, and tilt angle TA. In response to the lift and tilt and position signals, controller 124 can then compute lift angle LA and tilt angle TA. In other embodiments, memory 126 is programmed with look-up tables which relate the magnitude of the lift and tilt position signals to previously determined lift angles LA and tilt angles TA. In response to lift and tilt position signals of a predetermined magnitude, controller 124 simply implements an algorithm which searches the look-up table for the corresponding lift and tilt angle. Utilizing these or other known techniques, controller 124 can determine the position of boom assembly 22 and the position of bucket 24 in relation to boom assembly 22.

MANUAL BOOM AND BUCKET CONTROL MODE

Bucket positioning and control system 120 is operated in its manual boom and bucket control mode when bucket positioning mode switch 128 and bucket return to position (RTP) mode switch 130 are both set to their OFF position by the operator. When bucket positioning and control system 120 is operated in its manual boom and bucket control mode, hydraulic control subsystem 122 functions in a manner similar to that well known in the prior art and described above. Lift cylinders 62 will drive boom assembly 22 about its travel path 70 only when spool 146 of lift valve 144 is manually displaced from its neutral position by the operator through use of control handle 34. Similarly, tilt cylinders 64 will drive bucket 24 about its travel path 76 only when the operator manually actuates spool 142 of tilt valve 140 using control handle 34. However, in preferred embodiments of the present invention, the anti-rollback and tilt cushion modes described in subsequent portions of this specification override the manual boom and bucket control mode. Since tilt valve 140 and lift valve 144 are coupled to tilt cylinder 64 and lift cylinder 62, respectively, independent from tilt auxiliary valve 148, an operator can manually control boom assembly 22 and bucket 24 even if any elements of electrical subsystem 121 should fail. Excessive down time resulting from component failures can thereby be prevented.

BUCKET POSITIONING MODE

Bucket positioning and control subsystem 120 is enabled to operate in its bucket positioning mode when an operator sets bucket positioning mode switch 128 to its ON position, and bucket RTP mode switch 130 to its OFF position. When operated in the bucket positioning mode, bucket positioning and control system 120 causes bucket 24 to maintain a selected predetermined angular relationship or bucket angle BA with respect to chassis or support structure 16 of loader 10, as illustrated in FIG. 10.

Figure 10:
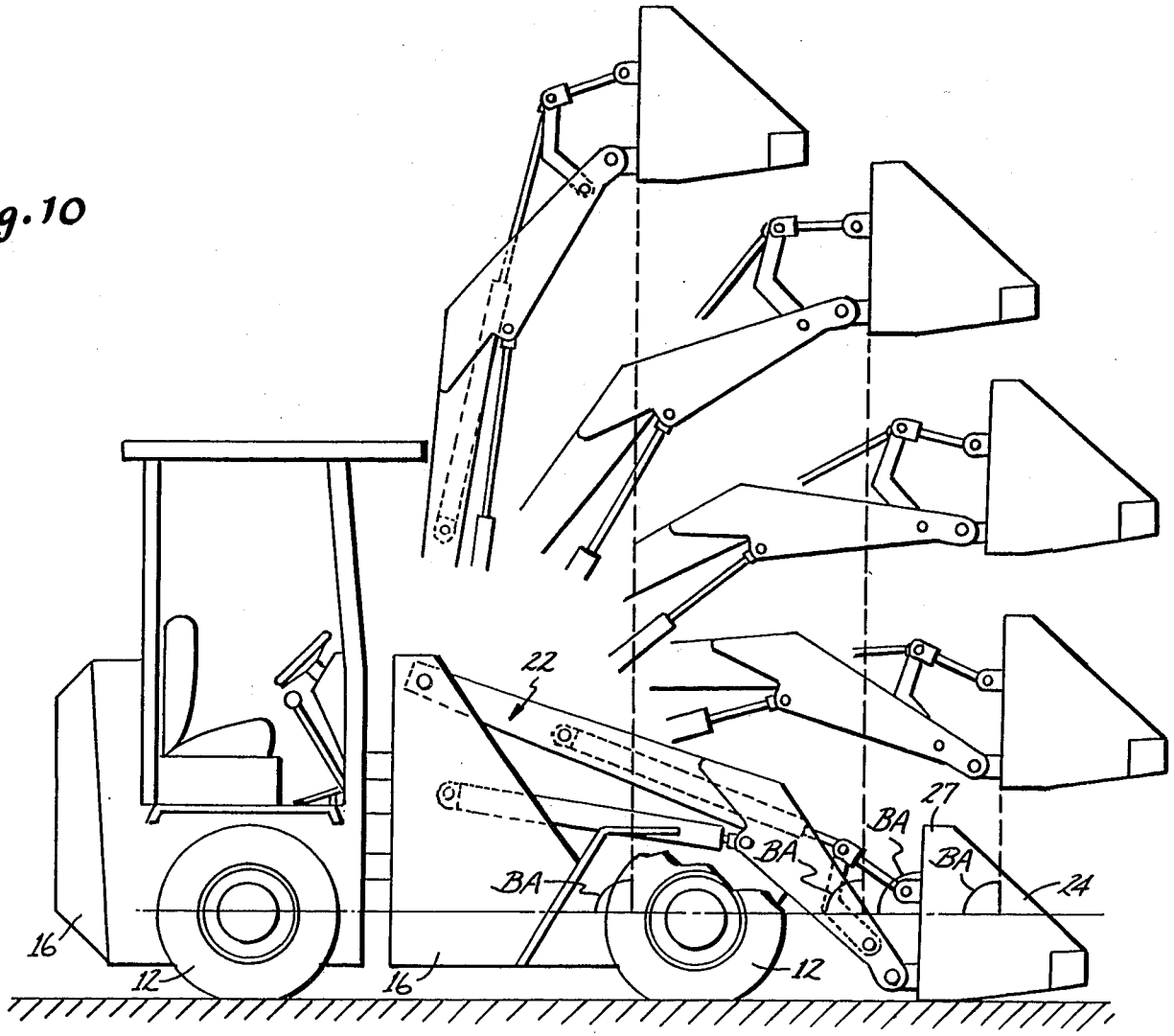
FIG. 10 is a view illustrating the boom assembly and bucket shown in FIG. 2 when the present invention is operated in its bucket leveling mode.

In FIG. 10, bucket angle BA is characterized as the angle formed between back plate 27 of bucket 24, and an axis extending between the center of wheels 12 on one side of loader 10. At any then current position or lift angle LA of boom assembly 22 already set by the operator, the operator can actuate control handle 34 to position bucket 24 at a desired tilt angle TA with respect to the boom assembly, thereby selecting the desired bucket angle BA with respect to support structure 16. When the operator releases control handle 34 returning tilt spool 142 to its neutral position, tilt switch 141 will stop providing manual lift signals, and controller 124 will cause data representative of the tilt and lift position signals to be stored in memory 126. Controller 124 then utilizes the stored data representative of the lift and tilt position signals to compute or otherwise determine the selected bucket angle (BA).

Once bucket angle BA is selected in this manner, controller 124 monitors the lift position signals and provides tilt control signals to bucket rollback solenoid 136 or bucket rollout solenoid 138 as needed to cause tilt auxiliary valve 148 to actuate tilt cylinders 64 and roll bucket 24 back or out to maintain the bucket at the selected bucket angle BA when the operator manually actuates control handle 34 to lower or raise boom assembly 22, respectively. For example, if lift valve 144 is actuated to raise boom assembly 22 by a given lift angle, controller 124 provides tilt control signals to rollout solenoid 138 causing tilt angle TA to increase by the same given angle over the same period of time. Bucket 24 will then be maintained at the same bucket angle BA throughout this motion.

Manual actuation of tilt valve 140 through the use of control handle 34 causes tilt switch 141 to provide manual tilt signals to controller 124. Controller 124 discontinues the production of leveling tilt control signals when manual tilt signals are received. The operator can therefore override the bucket leveling mode by actuating tilt valve 140 through control handle 34, and manually set bucket 24 to another desired position. When tilt spool 142 is returned to neutral position (i.e., when the operator is not actuating control handle 34), bucket positioning and control system 120 will again enter its bucket leveling mode causing bucket 24 to maintain the newly selected bucket angle BA in the manner described above.

As will be described in subsequent portions of this specification, the anti-rollback mode of bucket positioning and control system 120 overrides the bucket leveling mode in certain circumstances.

BUCKET RETURN TO POSITION (RTP) MODE

Bucket positioning and control system 120 is enabled to operate in its return to position (RTP) mode when the operator sets bucket RTP mode switch 130 to its ON position, and bucket positioning mode switch 128 to its OFF position. Using control handle 34, the operator can manually actuate tilt valve 140 to position bucket 24 at a predetermined position with respect to boom assembly 22. The operator then actuates RTP set switch 132 to select the predetermined position as the predetermined set position. When so actuated by the operator, RTP set switch 132 causes controller 124 to store data representative of the tilt position signals, and representative of the tilt angle TA at the selected set position, within memory 126. If RTP set switch 132 is not actuated after RTP mode switch 130 is set to its ON position, data representative of a default set position, such as bottom panel 25 of bucket 24 level with respect to support structure 16, is used.

After a predetermined set position is selected, the operator can use control handle 34 to actuate tilt valve 140 and lift valve 144 to manually drive bucket 24 and boom assembly 22 to any desired position. Whenever it is desired to return bucket 24 to its set position, the operator simply actuates RTP enable switch 42. Controller 124 will then provide return to position tilt control signals to rollback solenoid 136 or rollout solenoid 138 as required to roll bucket 24 back or out, respectively, to the selected set position. In one embodiment, rollback solenoid 136 or rollout solenoid 138 fully strokes tilt auxiliary valve 148 until sensor 89 of tilt cylinders 64 provide tilt position signals indicating that bucket 24 has been returned to the selected set position.

CONCURRENT USE OF BUCKET POSITIONING MODE AND BUCKET RTP MODE

Bucket positioning and control system 120 is simultaneously enabled to operate in both the bucket positioning mode and RTP mode previously described when the operator sets both RTP mode switch 130 and bucket positioning mode switch 128 to their ON position. When both the return to position and bucket positioning modes are selected in this manner, bucket positioning and control system 120 operates with the attributes of both individual modes as described above, with one exception.

If boom assembly 22 is being raised, the operation of bucket positioning and control system 120 in both the bucket positioning mode and bucket RTP mode is as previously described. However, controller 124 monitors the lift position signals received from sensors 89 of lift cylinders 62, and disables operation in the bucket positioning mode (i.e., does not provide tilt control signals), when the operator is using control handle 34 to lower boom assembly 22. When boom assembly 22 is being lowered and both RTP mode switch 130 and bucket positioning mode switch 128 are switched ON, the operator must actuate RTP enable switch 134 or manually actuate tilt valve 140 through the use of control handle 34, to roll bucket 24 back or out.

ANTI-ROLLBACK MODE

Figure 11:
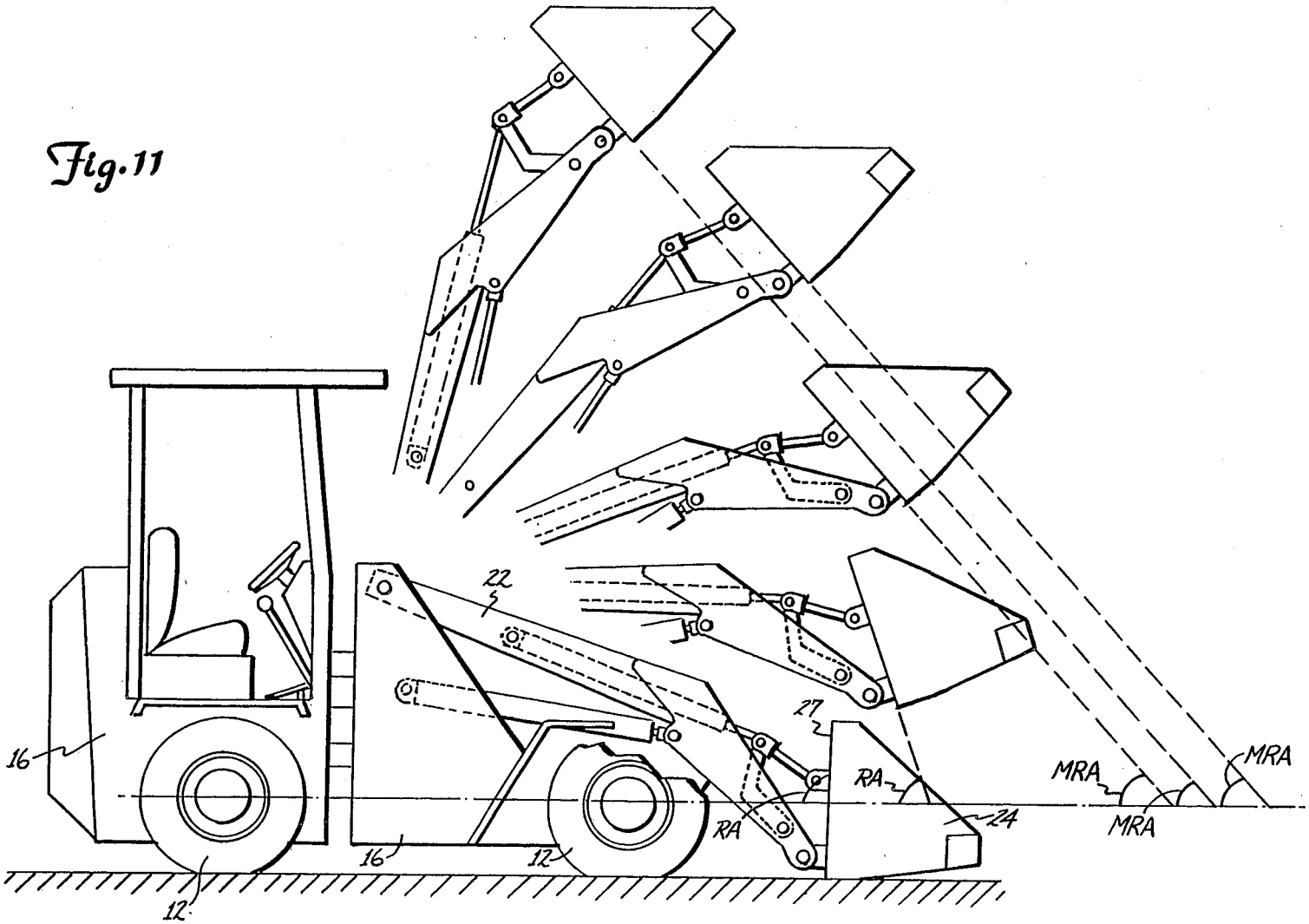
FIG. 11 is a view illustrating the boom assembly and bucket shown in FIG. 2 when the present invention is operated in its anti-rollback mode.

Bucket positioning and control system 120 is preferably programmed to continuously operate in its anti-rollback mode. In this mode of operation, as illustrated in FIG. 11, bucket positioning an control system 120 prevents spillage over back panel 27 of bucket 24 by preventing the bucket from being rolled back beyond a predetermined minimum rollout angle MRA with respect to the support structure or chassis 16 of loader 10. Rollout angle RA is characterized in FIG. 11 as the angle formed between back panel 27 of bucket 24 and an axis between the center of wheels 12 on one side of loader 10, and can be determined by controller 124 as a function of tilt angle TA and lift angle LA. Controller 124 can, for example, be programmed to ensure that rollout angle RA must be greater than or equal to the minimum rollout angle MRA.

Data representative of minimum rollout angle MRA can be stored in memory 126. When operated in the anti-rollback mode, controller 124 monitors the lift and tilt positions signals. Whenever controller 124 determines that the rollout angle RA computed as a function thereof is less than the minimum rollout angle MRA, tilt control signals are provided to rollout solenoid 138 causing tilt auxiliary valve 148 to roll bucket 24 out to the minimum rollout angle MRA.

If the operator should manually actuate tilt valve 140 in a direction which would cause bucket 24 to roll back beyond minimum rollout angle MRA, controller 140 provides tilt control signals which causes tilt auxiliary valve 148 to counter this motion and prevent bucket 24 from rolling back beyond the minimum rollout angle. If the operator should actuate control handle 34 to lift boom assembly 22 to a position which would cause bucket 24 to have a rollout angle less than minimum rollout angle MRA, controller 124 will simultaneously provide tilt control signals to rollout solenoid 138 which causes bucket 24 to roll out and be driven to minimum rollout angle MRA. If lift valve 144 is actuated to raise boom assembly 22 and tilt valve 140 is simultaneously actuated to roll bucket 24 back, resulting in bucket 24 being driven to a rollout angle MRA, motion of both lift cylinder 62 and tilt cylinder 64 will be stopped. Bucket 24 is thereby prevented from being driven to a rollout angle less than MRA. Since tilt valve 140 and lift valve 144 are located upstream from tilt auxiliary valve 148, the operator will be unable to override operation of bucket positioning and control system 120 in the anti-rollback mode using control handle 34. These operations are performed continuously as boom assembly 22 is raised.

The anti-rollback mode of operation described above overrides both the manual boom and bucket control mode of operation, bucket positioning mode, and return to position modes described above if their operations would tend to cause bucket 24 to have a rollout angle RA less than minimum rollout angle MRA.

TILT CUSHION MODE

Bucket positioning and control system 120 is preferably programmed to continuously operate in its tilt cushion mode to prevent unnecessary forces from being exerted on tilt cylinders 64. The operational life of tilt cylinders 64 can thereby be extended, while at the same time permitting the operator to bang bucket 24 to jar debris free. The following description of the tilt cushion mode is made with respect to FIGS. 3, 8 and 12.

Whenever sensors 89 of tilt cylinders 64 provide tilt position signals indicating that piston rods 74 are being extended and are within a first predetermined cushion distance such as two inches of the end of their stroke (i.e., piston 82 is within two inches of cylinder stop 87), controller 124 causes positioning and control system 120 to enter its tilt cushion mode. Data representative of the first predetermined distance will be stored within memory 126. Once the tilt cushion mode is entered, controller 124 provides cushioning tilt control signals to rollback solenoid 136.

Figure 12:
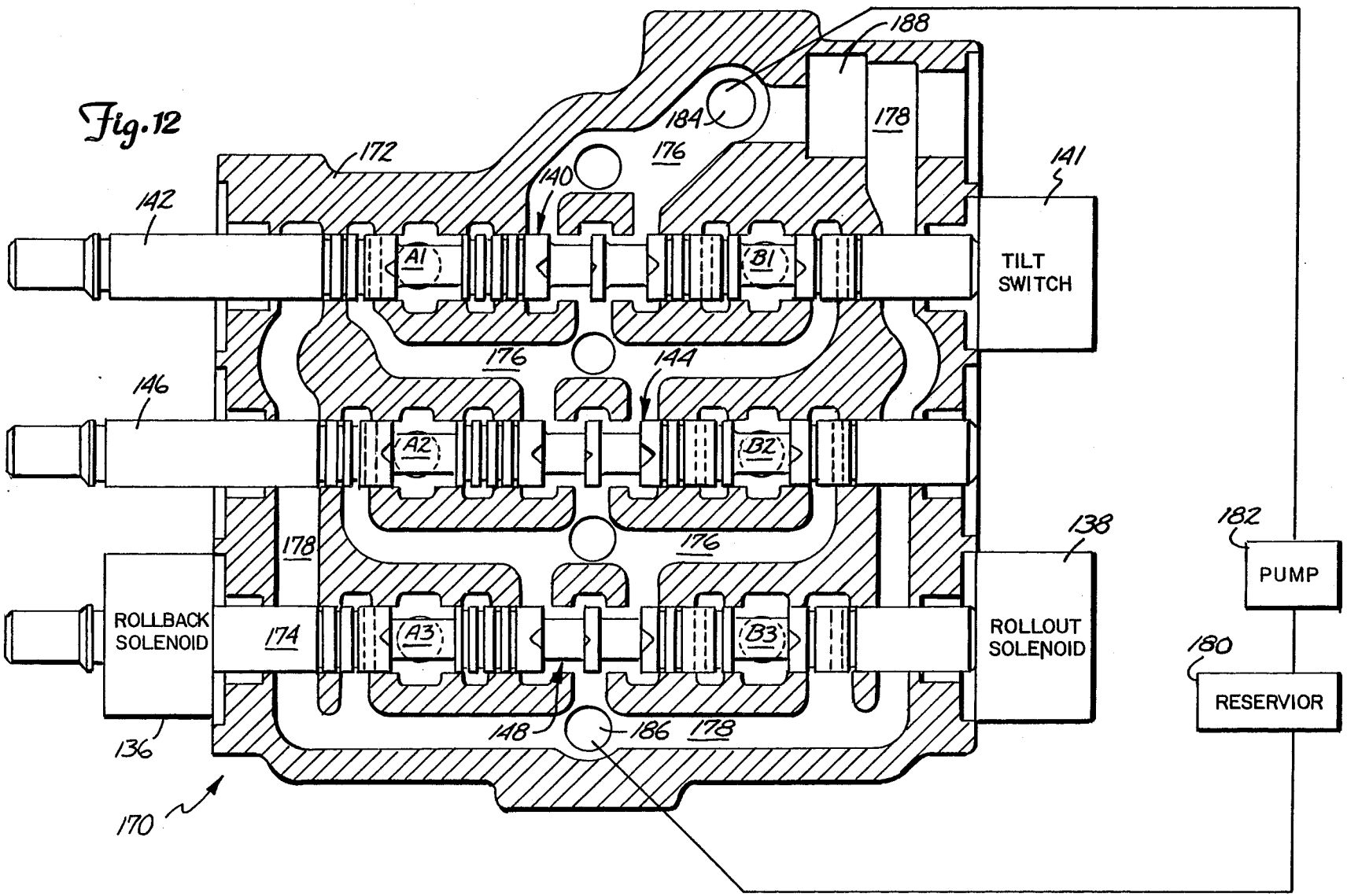
FIG. 12 is a detailed cross sectional view of the three spool series valve shown in FIG. 8.

In response to the tilt control signals, rollback solenoid 136 drives the spool of the tilt auxiliary valve in a direction (e.g. to the right in FIG. 12) opposite that of spool 142 of tilt valve 140 (e.g., to the left in FIG. 12). Hydraulic fluid flowing to base ports 88 of tilt cylinders 64 is thereby shunted through the external parallel hydraulic connection between the tilt and tilt auxiliary valves to the drain passageway of valve block 170, while fluid flow from rod ports 90 of the tilt cylinders is blocked. As a result, the speed of piston rods 74 is slowed, reducing the forces acting on cylinders 64 when pistons 82 meet cylinder stops 87.

If bucket 24 has been completely dumped, i.e., piston rods 74 fully extended from tilt cylinders 64, and then retracted less than a second predetermined cushion distance such as four inches, controller 124 overrides the tilt cushion mode of operation. Data representative of the second predetermined distance is also stored in memory 126. In other words, an operator can use control handle 34 to manually stroke tilt cylinders 64 to their full extent without entering the tilt cushion mode, provided that the tilt cylinder has not been retracted from its full rollout position by more than the second predetermined distance immediately before being again extended. This gives the operator the ability to bang tilt cylinders 64 with a limited stroke to jar debris from bucket 24 without damaging the cylinders.

CONCLUSION

The present invention is an electronic bucket positioning and control system which can be used in conjunction with the hydraulic systems typically found on vehicles. The electronic system is relatively simple, reliable and inexpensive. It is therefore commercially feasible to implement. As described above, the system is also very flexible and can operate in a variety of different modes.

Although the present invention has been described with reference to preferred embodiments, workers skilled in the art will recognize that changes may be made in form and detail without departing from the spirit and scope of the invention.

What is claimed is:

1. An electric attachment positioning and control system, including:

a support structure;

a boom assembly having a first end pivotally mounted to the support structure, and a second end;

an attachment pivotally mounted to the second end of the boom assembly;

at least one hydraulic lift cylinder for driving the boom assembly with respect to the support structure;

at least one hydraulic tilt cylinder for driving the attachment with respect to the boom assembly;

lift sensor means for providing lift position signals representative of the position of the boom assembly with respect to the support structure;

tilt sensor means for providing tilt position signals representative of the position of the attachment with respect to the boom assembly;

a multiple spool series valve including:

an operator actuated hydraulic tilt valve for controlling the tilt cylinder;

an operator actuated hydraulic lift valve for controlling the lift cylinder; and an electrically actuated hydraulic tilt valve responsive to tilt control signals for controlling the tilt cylinder, the electrically actuated hydraulic tilt valve and the operator actuated hydraulic tilt valve coupled to the hydraulic tilt cylinder in a parallel hydraulic circuit;

memory means for storing digital data; and digital control means coupled to the lift sensor means, tilt sensor means, memory means and electrically actuated tilt valve means for providing tilt control signals as a function of the stored digital data, lift position signals and tilt position signals.

2. The positioning and control system of claim 1 wherein:

the system further includes;

a hydraulic fluid reservoir for containing hydraulic fluid received from the series valve; and a pump for pumping hydraulic fluid from the reservoir; and the electrically actuated tilt valve is positioned downstream from the operator actuated tilt valve and the operator actuated lift valve.

3. The positioning and control system of claim 2 wherein the operator actuated lift valve is positioned between the operator actuated tilt valve and the electrically actuated tilt valve in the series valve.

4. The positioning and control system of claim 1 wherein:

the memory means stores data representative of a selected predetermined angular position of the attachment with respect to the support structure;

the system further includes positioning select means coupled to the control means for selecting the predetermined angular position and causing the memory means to store data representative of the selected predetermined angular position; and the control means provides positioning tilt control signals causing the attachment to maintain the selected predetermined angular position as the boom assembly is driven with respect to the support structure.

5. The positioning and control system of claim 4 and further including positioning mode switch means coupled to the control means for causing the system to operate in a positioning mode, and thereby provide the positioning tilt control signals, when actuated.

6. The positioning and control system of claim 1 wherein:

the memory means stores data representative of a selected return position of the attachment with respect to the boom assembly;

the system further includes return to position select means coupled to the control means for causing the memory means to store digital data representative of the selected return position; and the control means provides return to position tilt control signals causing the attachment to be driven to the selected return position.

7. The positioning and control system of claim 6 wherein the return to position select means includes return to position set switch means for causing the memory means to store data representative of a position with respect to the boom assembly to which the attachment has been driven through actuation of the operator actuated hydraulic tilt valve, as the selected return position, when actuated.

8. The positioning and control system of claim 7 and further including return to position enable switch means for causing the control means to produce the return to position tilt control signals, when actuated.

9. The positioning and control system of claim 1 wherein:

the system further includes means for causing the system to operate in an anti-rollback mode;

the memory means stores data representative of a predetermined minimum rollout angle of the attachment with respect to the support structure; and.

the control means provides anti-rollback tilt control signals preventing the attachment from being driven to a rollout angle less than the predetermined minimum rollout angle.

10. The positioning and control system of claim 1 wherein:

the hydraulic tilt cylinder includes a piston which can be driven between first and second end positions within a cylinder housing;

the memory means stores data representative of a first predetermined cushion distance; and the control means provides tilt cushion control signals causing the speed of the piston to slow when the piston is being driven within the cylinder housing toward the first end position and is within the first cushion distance of the first end position.

11. The vehicle of claim 10 wherein:

the memory means also stores data representative of a second cushion distance; and the control means disables production of the tilt cushion control signals when the piston is moved from the first end position by a distance less than the second cushion distance immediately before being driven toward the first end position.

12. The vehicle of claim 1 and further including tilt switch means responsive to the operator actuated hydraulic tilt valve for causing the control means to disable production of tilt control signals when the operator actuated hydraulic tilt valve is actuated.

13. A vehicle including:

a support structure;

boom assembly means pivotally mounted to the support structure;

an attachment pivotally mounted to the boom assembly means;

lift means for driving the boom assembly means with respect to the support structure;

at least one hydraulic tilt cylinder for driving the attachment with respect to the boom assembly means;

an electrically actuated hydraulic tilt valve responsive to tilt control signals for controlling the tilt cylinder;

an operator actuated hydraulic tilt valve for controlling the hydraulic tilt cylinder and coupled to the tilt cylinder in a parallel hydraulic circuit with the electrically actuated hydraulic tilt valve;

sensor means for providing position signals representative of the angular position of the attachment with respect to the support structure;

memory means for storing data representative of a predetermined minimum rollout angle of the attachment with respect to the support structure; and control means coupled to the sensor means, electrically actuated hydraulic tilt valve, and memory means for providing anti-rollback tilt control signals preventing the attachment from being driven to a rollout angle with respect to the support structure which is less than the minimum rollout angle.

14. The vehicle of claim 13 wherein:

the vehicle further includes operator actuated lift actuator means for controlling the lift means; and the control means provides the anti-rollback tilt control signals when the operator actuates the operator actuated lift actuator means in a manner tending to cause the attachment to have a rollout angle with respect to the support structure which is less than the minimum rollout angle.

15. The vehicle of claim 13 wherein:

the vehicle further includes a hydraulic pump and a hydraulic fluid reservoir; and the electrically actuated hydraulic tilt valve and the operator actuated hydraulic tilt valve are coupled to each other and the hydraulic pump and fluid reservoir in a series hydraulic circuit.

16. The vehicle of claim 15 wherein the electrically actuated hydraulic tilt valve is located downstream from the operator actuated tilt valve in the series hydraulic circuit.

17. The vehicle of claim 16 and further including a hydraulic lift valve connected in the series hydraulic circuit between the operator actuated tilt valve and the electrically actuated tilt valve, for controlling the lift means.

18. A vehicle including:

a support structure;

an attachment pivotally mounted with respect to the support structure;

hydraulic tilt cylinder means having a piston which can be driven between first and second end positions within a cylinder housing, for driving the attachment with respect to the support structure;

electrically actuated tilt valve means responsive to tilt cushion control signals for controlling the tilt cylinder means;

tilt sensor means for providing tilt position signals representative of the position of the piston within the cylinder housing of the tilt cylinder means;

memory means for storing data representative of a first cushion distance and a second cushion distance with respect to the first end position; and control means coupled to the electrically actuated tilt valve means, tilt sensor means and memory means for providing tilt cushion control signals causing the electrically actuated tilt valve means to be actuated in a manner causing speed of the piston to slow when the piston is being driven within the cylinder housing toward the first end position and is within the first cushion distance of the first end position, and to disable production of the tilt cushion control signals if the piston is moved from the first end position by a distance less than the second cushion distance immediately before being driven toward the first end position, whereby tilt cushion control signals are produced when the piston is within the first cushion distance only if the piston is being driven toward the first end position from a distance greater than the second cushion distance.

19. The vehicle of claim 18 and further including operator actuated tilt valve means for controlling the hydraulic tilt cylinder means and coupled to the hydraulic tilt cylinder means in a parallel hydraulic circuit with the electrically actuated tilt valve means.

20. The vehicle of claim 19 wherein:

the vehicle further includes a hydraulic pump and a hydraulic fluid reservoir; and the electrically actuated hydraulic tilt valve and the operator actuated hydraulic tilt valve are coupled to each other and the hydraulic pump and fluid reservoir in a series hydraulic circuit.

21. The vehicle of claim 20 wherein the electrically actuated hydraulic tilt valve is located downstream from the operator actuated tilt valve means in the series hydraulic circuit.

22. A vehicle including:

a support structure;

an attachment pivotally mounted with respect to the support structure;

hydraulic tilt cylinder means having a piston which can be driven between first and second end positions within a cylinder housing, for driving the attachment with respect to the support structure;

electrically actuated tilt valve means responsive to tilt cushion control signals for controlling the tilt cylinder means;

tilt sensor means for providing tilt position signals representative of the position of the piston within the cylinder housing of the tilt cylinder means;

memory means for storing data representative of a cushion distance; and control means coupled to the electrically actuated tilt valve means, tilt sensor means and memory means for providing tilt cushion control signals causing the electrically actuated tilt valve means to be actuated in a manner causing speed of the piston to slow when the piston is being driven within the cylinder housing toward the first end position from a distance greater than the cushion distance from the first end position and is within the cushion distance of the first end position, and to disable production of the tilt cushion control signals if the piston is moved from the first end position by a distance less than the cushion distance immediately before being driven toward the first end position.

23. The vehicle of claim 22 and further including operator actuated tilt valve means for controlling the hydraulic tilt cylinder means and coupled to the hydraulic tilt cylinder means in a parallel hydraulic circuit with the electrically actuated tilt valve means.

24. The vehicle of claim 23 wherein:

the vehicle further includes a hydraulic pump and a hydraulic fluid reservoir; and the electrically actuated hydraulic tilt valve means and the operator actuated hydraulic tilt valve means are coupled to each other and the hydraulic pump and fluid reservoir in a series hydraulic circuit.

25. The vehicle of claim 24 wherein the electrically actuated hydraulic tilt valve means is located downstream from the operator actuated tilt valve means in the series hydraulic circuit.

26. The system of claim 4 wherein the positioning select means includes tilt switch means responsive to the operator actuated hydraulic tilt valve and coupled to the control means for providing tilt signals representative of operator actuation of the operator actuated tilt valve, wherein the control means causes the memory means to store digital data representative of the angular position of the attachment with respect to the support structure, selected by the operator through actuation of the operator actuated tilt valve, as the selected predetermined angular position.

27. The system of claim 8 and further including return to position mode switch means coupled to the control means for causing the system to operate in a return to position mode, and thereby provide the return to position tilt control signals, when actuated.

* * * * *

UNITED STATES PATENT AND TRADEMARK OFFICE

CERTIFICATE OF CORRECTION

PATENT NO. : 4,844,685

DATED : July 4, 1989

INVENTOR(S) : Thomas M. Sagaser

It is certified that error appears in the above-identified patent and that said Letters Patent is hereby corrected as shown below:

On the title page:

In the References Cited Section, under OTHER PUBLICATIONS list the following:

Enerpac Brochures as taken from the August, 1986 issue of "AUTOMOTIVE ENGINEERING"

Data Sheet by Enerpac, "Turnkey Custom Motion Control. . . Without Custom Development Costs"

Data Sheet By Enerpac, "Pulsar VP Series Directional Control Valve"

Signed and Sealed this

Seventh Day of May, 1991

*Attest:*

*Attesting Officer*

HARRY F. MANBECK, JR.

*Commissioner of Patents and Trademarks*